US007303398B2

(12) United States Patent
Soto

(10) Patent No.: US 7,303,398 B2
(45) Date of Patent: Dec. 4, 2007

(54) EDUCATIONAL GAME

(76) Inventor: Susan Lynn Soto, 1149 E. Sandpiper, Unit 211, Tempe, AZ (US) 85283

( * ) Notice: Subject to any disclaimer, the term of this patent is extended or adjusted under 35 U.S.C. 154(b) by 189 days.

(21) Appl. No.: 10/965,950

(22) Filed: Oct. 14, 2004

(65) Prior Publication Data

US 2006/0082060 A1 Apr. 20, 2006

(51) Int. Cl.
*G09B 19/22* (2006.01)

(52) U.S. Cl. ..... 434/128; 273/279

(58) Field of Classification Search ..... 434/128; 273/236, 242, 243, 244, 250–254, 256, 257, 273/259, 278, 279, 287
See application file for complete search history.

(56) References Cited

U.S. PATENT DOCUMENTS 4,121,823 A * 10/1978 McBride ..... 273/249
4,728,107 A * 3/1988 Dvorak et al. ..... 273/273
4,856,780 A * 8/1989 Begley et al. ..... 273/244
4,889,344 A * 12/1989 Zimba ..... 273/243
4,893,819 A * 1/1990 Wright ..... 273/243
4,907,808 A * 3/1990 Turner et al. ..... 273/240
4,940,239 A * 7/1990 Tuttle ..... 273/243
5,042,816 A * 8/1991 Davis et al. ..... 273/243
5,137,279 A * 8/1992 Murphy et al. ..... 273/257
5,318,447 A * 6/1994 Mooney ..... 434/128
5,405,150 A * 4/1995 Loder ..... 273/430
5,645,280 A * 7/1997 Zelmer ..... 273/256
5,749,580 A * 5/1998 Lopez ..... 273/243
5,876,211 A * 3/1999 Schmoyer et al. ..... 434/128
5,906,371 A * 5/1999 Peterson ..... 273/249
6,019,371 A * 2/2000 Mantis ..... 273/256
6,267,375 B1 * 7/2001 Bernstein et al. ..... 273/242
6,270,077 B1 * 8/2001 Cohen ..... 273/273
6,547,245 B1 * 4/2003 Olutunfese ..... 273/248
6,648,648 B1 * 11/2003 O'Connell ..... 434/188
6,729,884 B1 * 5/2004 Kelton et al. ..... 434/236

(Continued)

OTHER PUBLICATIONS

Diana Nelson Jones, "The Hard Road from Park Place to Baltic", Dec. 5, 2002 [retrieved online Jan. 4, 2007].*

*Primary Examiner*—Kurt Fernstrom
(74) *Attorney, Agent, or Firm*—Gallagher & Kennedy, P.A.; Thomas D. MacBlain

(57) ABSTRACT

An instructional board of computer game defines a path of movement for a number of game "pieces" that are moved along the path a number of "stops" as determined by a die or other random device. Associated with the stops and color or otherwise visually coded therewith are sets of cards bearing the questions all relating to a subject of instruction. Game rules call for a player or team whose piece lands on a stop "owned" by another player or team to answer a question printed on the face of the card of the other player. A correct answer earns points for the answering player or team as well as for the team or player that poses the question. "Free" stops imprinted on the board or programmed into the computer display are locations where the game rules call for a player whose piece lands there to obtain points without answering a question because the "free" stop is associated with worthwhile activity the player is deemed to have participated in. Preferably, the game is associated with a lesson plan devoted to the subject that is the theme of the game. In one particular embodiment the subject is public policy.

28 Claims, 5 Drawing Sheets

U.S. PATENT DOCUMENTS 7,007,952 B2 * 3/2006 Nelson ..... 273/242
2002/0180153 A1 * 12/2002 Casey et al. ..... 273/298
2004/0212149 A1 * 10/2004 Farmer et al. ..... 273/242
2004/0227289 A1 * 11/2004 Laibson et al. ..... 273/243
2005/0051957 A1 * 3/2005 Rice-Lincoln ..... 273/243
2006/0043675 A1 * 3/2006 Clover ..... 273/257

* cited by examiner

| | |
|---|---|
| Player 4 | SCORE III |
| 47 Player 3 | SCORE ~~IIII~~ |
| Player 2 | SCORE II |
| Player 1 | SCORE III |

EDUCATIONAL GAME

FIELD OF THE INVENTION

This invention relates to educational games and more particularly to an educational game in which players move pieces to stops along a path causing questions pertinent to a course of study to be posed to them by other players and to win or lose the game depending on the answers given.

BACKGROUND

Board games and computer games simulating board games have been known in which players are associated with pieces that move along a path in dependence on the throw of a die, the spin of a pointer, or the generation of a random number. Similarly, games have been known that are won or lost depending upon the players' ability to answer questions posed by other players.

However, those games in which players move pieces along the path and those games in which players are called on to answer questions are generally not combined, and moreover, they are not combined into an educational game devoted to the teaching of a particular subject where the questions posed are questions relating to the subject and that are posed at least partly in dependence on the place on a path along the board on which a player's playing piece lands.

Also, while educational games of various kinds have been known, a systematic method for developing and making an educational game relating to a chosen topic of study has not been put forth insofar as the inventor is aware.

BRIEF SUMMARY

In accordance with this invention an instructional game includes a real or virtual (;i.e. computer generated) game board with printed indicia representing a playing field, a representation of a path along the board starting from a beginning location, a number of real or virtual players' game pieces moveable along the path to stops along the path that may be "owned" by an opposing player or team, who is then permitted to pose a question from a playing card, the question relating to a particular topic of study. The number of stops that a piece is moved is determined by a random device such as a die, a spinning pointer, or a random number generator. Each player or team has a number of the stops identified with them or "owned" by them. Each player or team has a set of cards (again real or virtual) that are associated with their stops. The cards carry on one face questions that are to be posed and their associated answers. Preferably, as in the described preferred embodiment, the cards, the playing pieces, and the stops to be associated with one player or team of players are numbered, lettered, color coded, or otherwise marked for easy association of the playing piece, the cards, and the stops that are "owned" by that player or team. In a particular preferred embodiment of the invention, the questions and answers on the cards all relate to a particular educational topic. In one particularly preferred embodiment that topic is public policy, the game teaching what public policy is and how it is implemented.

In the preferred exemplary embodiment described, points are accumulated by a player or team for each question that player or team answers correctly. Points are also awarded to the team that asks the question that is correctly answered in one exemplary embodiment. The winning player or team may be the team that accumulates the most points upon one pass along the path on the board by one or all teams. The winning team may be the team that accumulates the most points when all of the questions have been posed or when all the questions have been answered correctly.

The path along the real or virtual game board can include safe stops or landing places where, if a player's piece lands there, the player need not answer a question. Upon landing on the safe stop, which may be located at corners of the board, the player may, as in a preferred embodiment, be rewarded with one or more points because those safe stops are indicative of, or representative of, particular laudatory activities associated with the subject matter of the game. In the preferred exemplary embodiment where the game relates to public policy, the stops may be associated with or represent, e.g., voting, attending public meetings, running for office, petitioning one's law maker, or other public policy affecting endeavors.

The stops on the board that are associated with a particular player or team can be sequential stops along one side of the board such that that player or team can be said to "own" one side of the board. In a particular preferred and exemplary embodiment, among the cards provided for playing the game is a sample card containing the first question to be answered. This question is delivered by the team that will be the first to have the other player or team's pieces pass or land on its stops. The sample card and its sample question and answer do not add a point or points to the answering player or team's score, but only serve as an example of how the game is to be played. Preferably, as in the exemplary embodiment described, the sample question is broadly relevant to the entire subject matter of the game.

The game of the invention is designed in particular for classroom use and has an associated teacher's lesson plan. The game and the lesson plan are designed to compliment one another. The game of this invention typically includes game instructions that direct the awarding of one or more points for particular questions, for landing on the safe stops, for posing a question that is correctly answered, etc.

As stated, the game of the present invention can be realized in actual physical objects such as the board, the cards, the die, the pieces or the game can readily be computer implemented and some or all of the board, the cards, the die and the pieces can be virtual. In this regard, the present invention includes a computer program implementing the game as described In another aspect of this invention there is provided a systematic method of developing and implementing an educational game relating to a particular topic of study. This method includes identifying the topic of study, devising questions and answers relating to the subject, imprinting the questions and answers at sites that may be on one side of a deck of real or virtual cards, providing real or virtual game pieces with real or virtual indicia representing a game piece path, dividing the path into stops for game pieces, real or virtual, marking groups of the stops, sets of the cards, and the pieces with the same or similar markings or colors for visual association (as by color coding, numbering, lettering or surface design) of each piece with a group of the stops and a set of the cards, and providing a real or virtual random number generating device for randomly determining movement of the pieces a number of stops.

The above and further objects and advantages of this invention will be better appreciated from a reading of the following detailed description of one or more preferred embodiments of the invention taken in consideration with the accompanying drawings.

DETAILED DESCRIPTION

Figure 1:
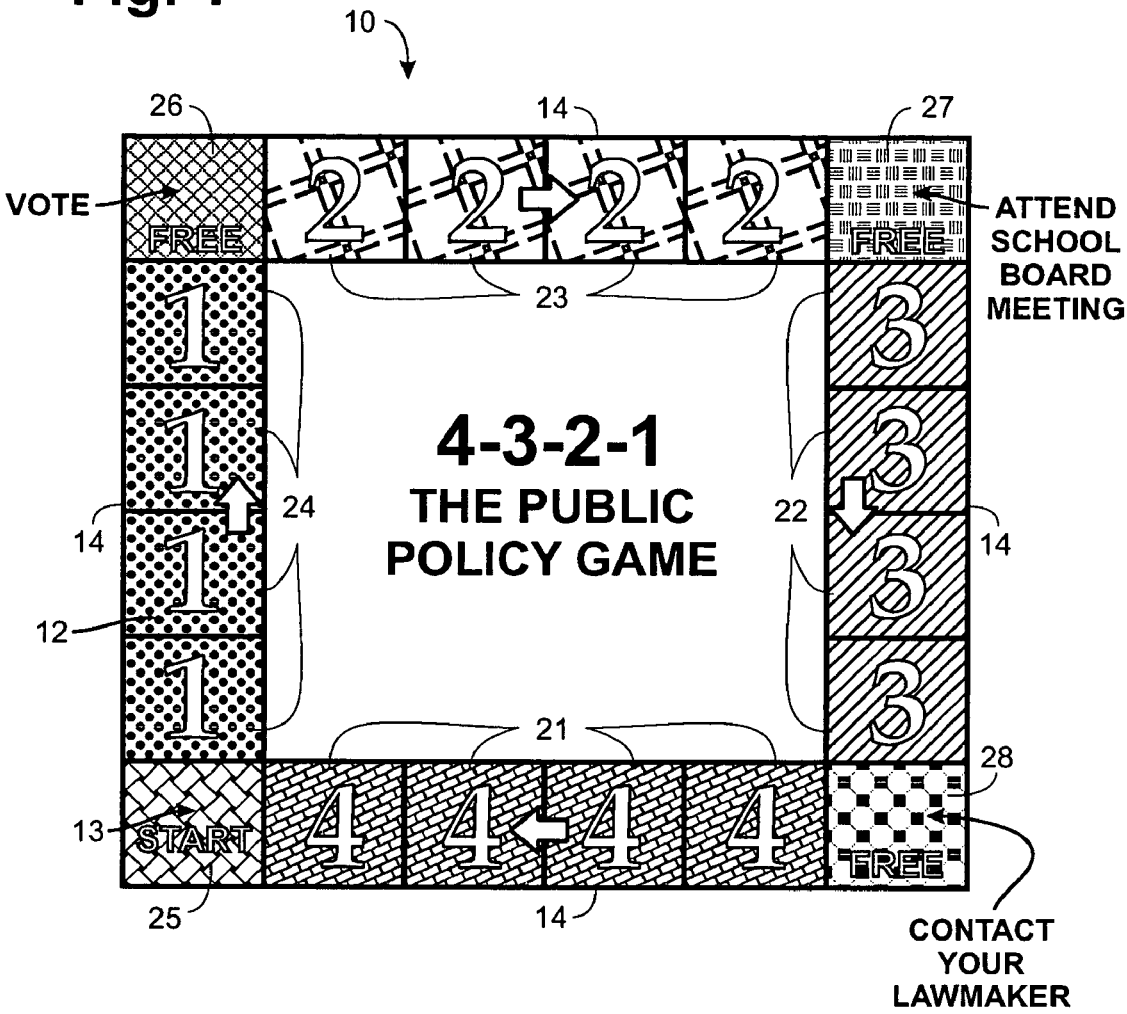
FIG. 1 is a top plan view of a game board or virtual game board in accordance with the present invention.
Figure 2:
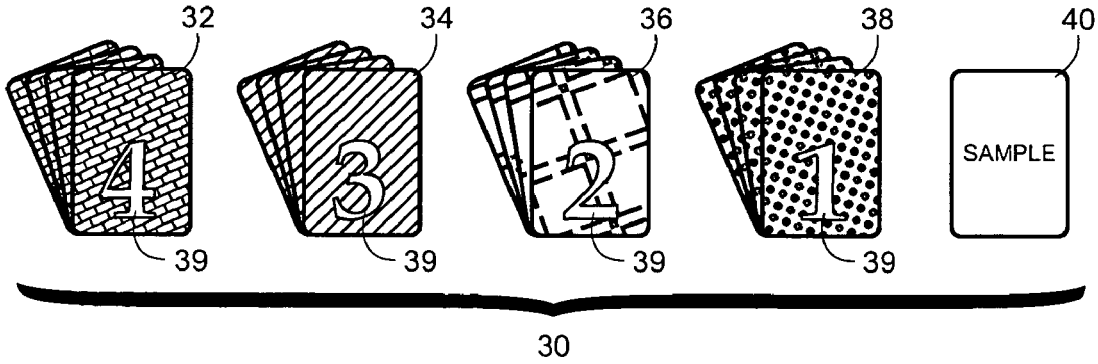
FIG. 2 is a top plan view of a deck of playing cards divided into groups to be associated with particular players or teams of players.

As shown in FIG. 1 a game board 10 has printed indicia representing a path 12 from a beginning location 13 around edges 14 of the board. Stops 21, 22, 23, 24, 25, 26, 27 divide the path around the board. In this actual, physical (as opposed to virtual) embodiment, the game board that is imprinted with the path may be the familiar foldable cardboard board such as is used in other boxed board games or it may be a flexible sheet imprinted to display the playing field and its path and fabricated of plastic laminated paper, sheet plastic or even cloth, for example.

Figure 3:
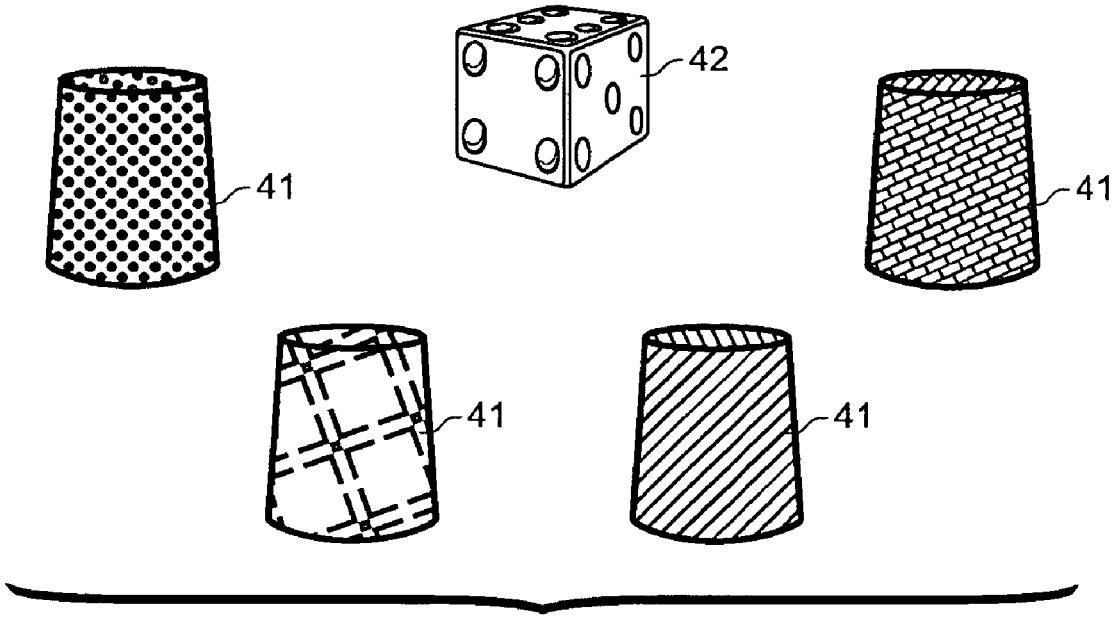
FIG. 3 is a perspective view of a die and playing pieces associated with the cards and the board of FIGS. 2 and 1.
Figure 4:
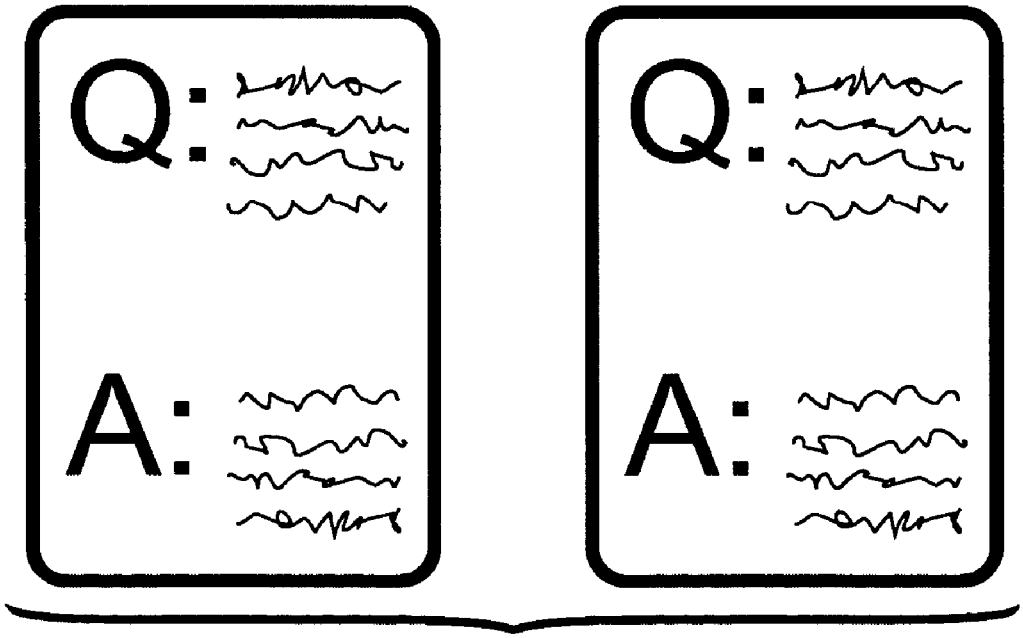
FIG. 4 is a top plan view of a pair of the cards of FIG. 3 showing the reverse side from that shown in FIG. 1 and imprinted with a question and answer related to a subject matter central to the playing of the game.

The game of the invention can be played among four individual players or four teams of players. As used herein, then, "player" or "players" refer to either individuals or teams. A deck of playing cards 30 is divided into four groups 32, 34, 36 and 38, each group to be given to a player or team of players of the game. The deck 30 includes, as well, a "sample" card 40. The groups of cards 32, 34, 36 and 38 and the stops 21, 22, 23 and 24 are color (or otherwise) coded on one face, which is to say they are marked with the same colors (or other marking) and are associated with a particular player or team of players. Other than by color, they may be coded for association by cross hatching or other surface design, by numerals, as shown at 39, or by letters, to name a few examples. A group of four game pieces 41 is shown in FIG. 3. The game pieces should be distinct from one another so that players are readily able to distinguish their own from those of others. Preferably they bear the same distinguishing colors or other markings as the sets of cards and the stops that are owned by the players. As illustrated in FIG. 3, the cards of the groups 32, 34, 36 and 38 are marked on their other face with a question relating to the topic of the game and the answer to the question.

A die 42 is shown in FIG. 3 and serves as the substantially random number generating device that sets the number of stops a piece should be moved. Of course, the device for setting this number could be a spinning pointer as is known or other means for developing a low number substantially randomly.

Figures 5, 6:
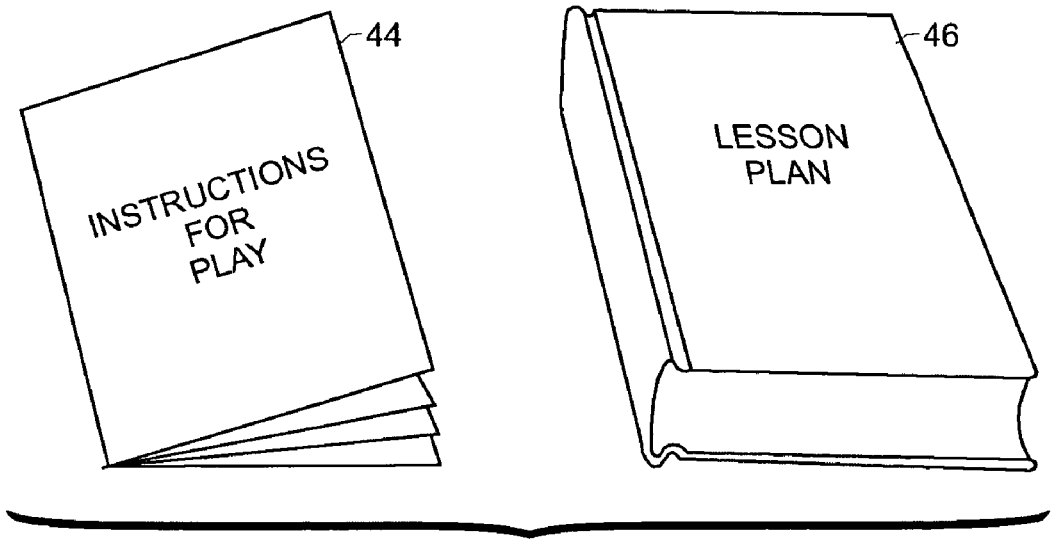
FIG. 5 is a top plan view of a score card for keeping score during the playing of the game.
FIG. 6 is a perspective view of an instruction pamphlet or booklet with rules of the game and a teacher's lesson plan for use in teaching the subject matter of the game in association with the play of the game.

As shown in FIG. 6 a set of written instructions 44 for the game is provided and, importantly, a lesson plan 46 is provided by which a teacher can incorporate the playing of the game into a lesson on the game's central theme or subject. In play, and in accordance with the instructions, it is first determined which players will be associated with which sides of the board and this determines the order in which play proceeds. This is determined in any conventional way, as by the throwing of the die 42 or by simply choosing. The player farthest around the board 10, whose stops 21 and cards 34 are designated "4" goes first. First, however, a designated player, player #1 for example, is given the sample card 40. The die 42 is thrown. The teacher moves a piece 41 (any piece) the shown number of stops. The teacher then asks player #1 to please read the question. The teacher then correctly answers the question and may indicate that if she were an actual player the appointed scorekeeper would have entered a point in that player's score on a score card 47 (FIG. 5.) The die 42 is again cast. The appropriately colored game piece 41 is moved by its player the number that the die 42 shows upright. If this places that player or team's piece 41 on a stop 24 along the side of the board "owned" by the player designated "1", then player #1 selects, from the cards that it holds, a question to be posed to player #4. Player #4 then gives his or her answer. If the answer is correct, the player #4 earns a prescribed number of points. These are entered onto the score card 47 in association with player #4. In a preferred embodiment the player, player #1, who posed the correctly answered question is also awarded a prescribed number of points and these too are entered on the scorecard 47 in association with player #1. A wrong answer results in no points being awarded.

Next player #3 rolls the die 42, moves his or her piece 41 the indicated number of stops and the player on whose stop player #3" piece lands picks from her or his cards and asks a question printed on the card. Again a correct answer gains points for player #3 as well as the player posing the question. And play continues in this fashion.

Certain stops along the path 12 earn a player "free" points, for which no question need be answered. This might be the corner squares 26, 27 and 28, for example. These generally are associated with an activity that a player is credited with having participated in upon her or his piece landing there. In the game devoted to teaching concepts of public policy squares 26, 27 and 28 represent attending a school board meeting, attending a town meeting, petitioning a law maker, voting or running for office, for example.

The game of the invention can be concluded in one of several ways. For a short game, the game can end when all players have gone around the board once, their pieces having passed or landed on the "start" square 25. Alternatively the game can come to a conclusion when all questions have been answered or when all questions have been answered correctly.

Figure 7:
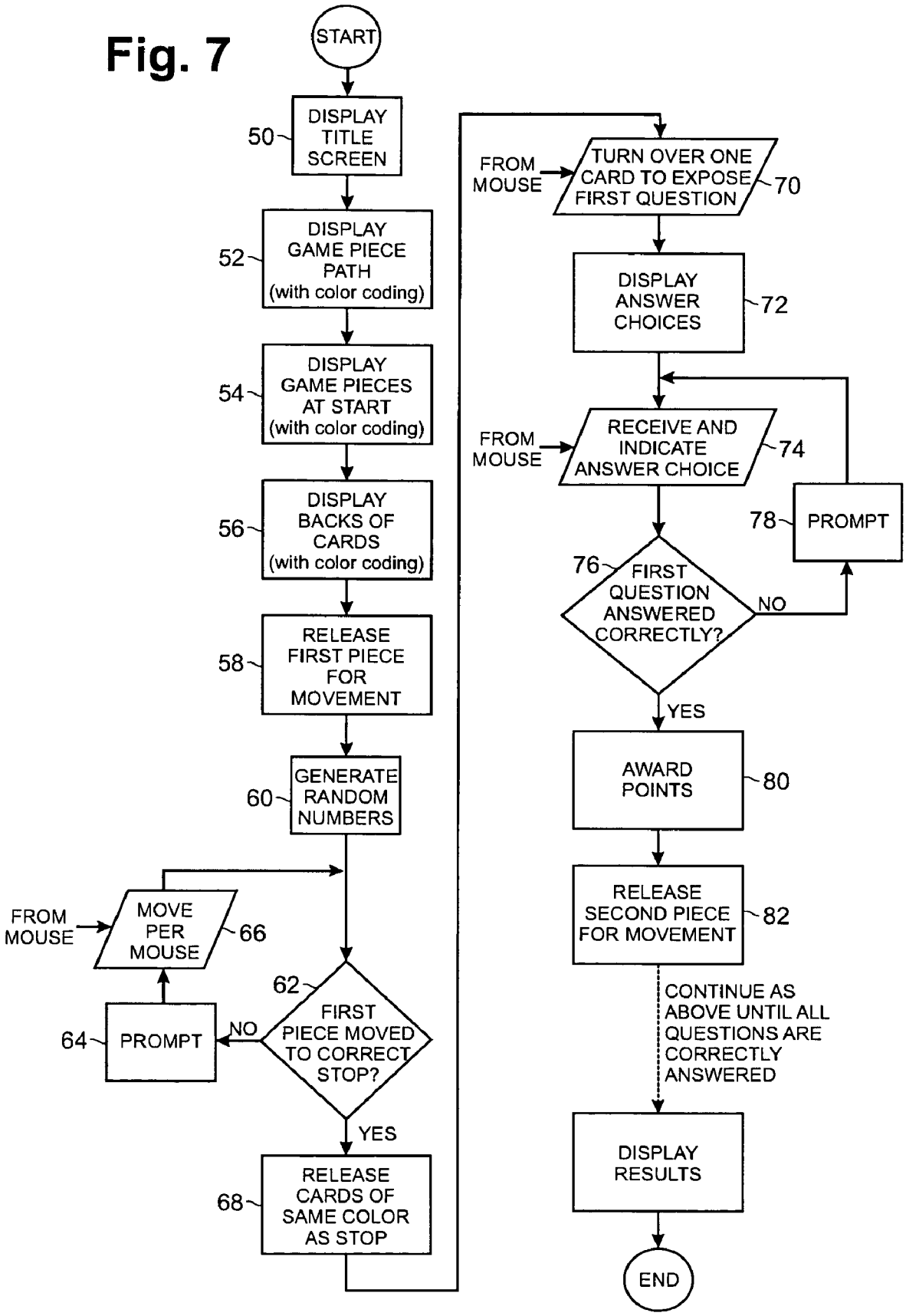
FIG. 7 is a flow chart of a computer program implementing the game of FIGS. 1-6.

As shown in FIG. 7, programming to run a computer rendition of the game of the invention displays, at 50, a title screen on a computer monitor connected with a desk top or lap top computer for example. At 52 the piece path like the path 12 of FIG. 1 is shown on the monitor including the color or other coding that sets apart stops like the stops 21, 22, 23 and 24 that are "owned" by one or another player or team of players. At 54 the game pieces are displayed at the start square like square 25 of the physical embodiment of the game shown in FIG. 1. Again, the game pieces bear the same color coding or other coding associating them with the players, the player's stops 21, 22, 23 and 24 and the sets of cards with color or other coding displayed at 56. At 58 a first of the game pieces displayed at the start position gets released for movement. This may be by permitting the movement of a cursor by mouse, or other interface to the piece and left-clicking on the piece to enable the piece to be dragged to a particular stop on the path. At 60 a random number is generated. This may be the last digit of a larger number generated by a known random number generation routine or chip. In association with this step, the casting of a die or the spinning of a pointer may be depicted on the computer screen.

The program of FIG. 7 steps to a decision block 62 where it is determined whether or not the piece that has been released for movement has been moved a number of stops responding to the number generated at 60. If the answer is no, which will be the case before the piece is moved, then the player is prompted at 64 and instructions are taken from the mouse at 66 to move the piece. Again at 62 it is determined whether the piece has been moved to the correct stop. If the answer is no the same loop is entered, but if the answer is yes then cards the same color as the color of the stop on which the first piece now resides are released 68 to allow one to be turned face up at 70 upon instruction from a mouse. The instruction from the mouse may be placing of the cursor on the desired card and left clicking or double clicking. Of course, turning the one card over exposes a first question and in the case of the computer implemented game either a multiple choice set of answers with, for example, associated check boxes, or a true or false choice with associated check boxes.

With the answer choices displayed at 72, the program responds to an instruction from the mouse at 74 to indicate the answer choice. Typically a choice of answers is made by dragging the cursor to the check box associated with the answer desired and clicking to place a check or bullet in the associated box. Again a decision block is entered at 76 where it is determined whether the first question has been correctly answered. If not, the program loops back to a prompt 78 and then to the previous block 74 for selection of a different answer. Such looping continues until at 76 it is determined that the answer has been correctly given. With the answer correctly given, points are awarded at 80 to the answering player or team and points are awarded to the team that turned over its card to pose the question.

In the event that the computer game parallels the board game described, as is contemplated, this first series of steps or routines may relate to the posing of the sample question by which a teacher demonstrates how the game is played. In that case, then, the pieces are returned to the start position, the order of play is determined, and the program begins fresh at block 48 and proceeds as discussed through block 80. At that point, a second piece is released for movement at 82 and the same series of steps occurs with respect to the second piece and the particular stop on which it lands, the questions posed, and the awarding of points. Of course, any time a piece lands on one of the "free" stops like the stops 26, 27 and 28 of FIG. 1, the program automatically awards the player or team whose piece lands there with the appropriate number of points for having engaged in the activity associated with that particular location. At the end, the results are displayed, establishing the winning team. Throughout, the standing of the four players of four teams may be either continuously shown on the monitor or may be called up at will.

The invention, it will be seen, is broader than just the one game developed to support one course of instruction. Its method of preparing an instructional game will apply to numerous subjects so that an active, competitive and fun activity teaches and reinforces lesson more assuredly than might be the case merely by classroom lecture or by reading assignment.

Figure 8:
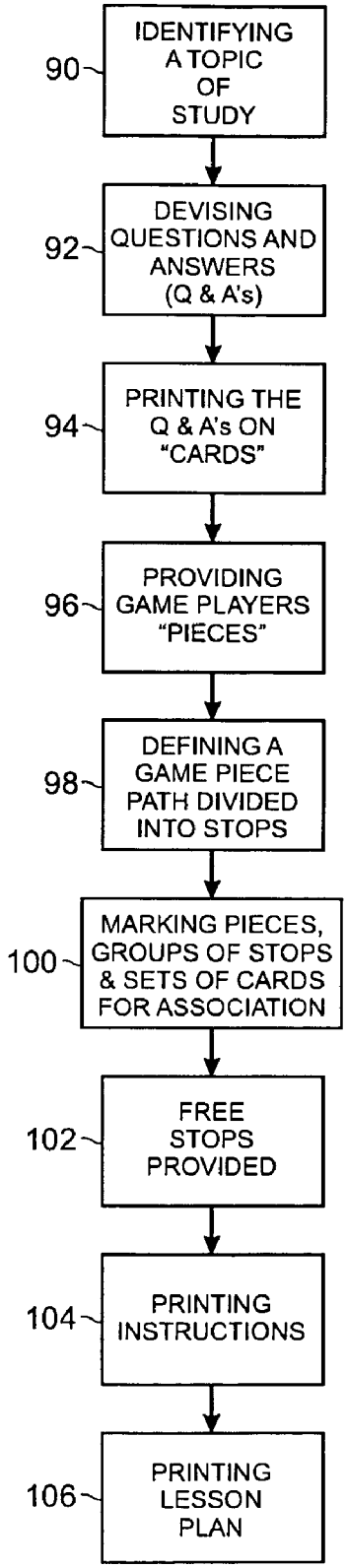
FIG. 8 is a flow chart of steps in the process of preparing an instructional game like the game of FIGS. 1-6.

FIG. 8 lays out the steps in the method of preparing a game like that described here. At step 90 the topic of study is identified. Questions and answers are devised at step 92. The questions and answers are printed at 94 on either cards or virtual cards in a computer game. At 96, game playing "pieces" color coded or otherwise coded the same as the cards are provided. A game piece path is defined by printing or programming at 98. The groups of stops that are to be "owned" by each player or team are commonly coded with the pieces and the cards at 100.

Activities in support of the lesson are identified and are assigned to free stops at 102. At 104 game instructions particular to the lesson are printed and at 106 a lesson plan to be used in association with the game is printed.

Returning to step 92 of FIG. 8, one of the questions and answers may be the sample question and answer that broadly introduces the subject. As an example, where the subject was public policy, the associated lesson plan called for the teaching of examples where students had affected public policy. The sample question then asked what the students had to learn before they could make changes in their schools and communities. The multiple choices were public policy, the United States president, and how to vote. The answer, of course, was public policy since they had to learn about their government and how public policy is affected.

Although preferred embodiments of the invention have been described in detail, it will be readily appreciated by those skilled in the art that further modifications, alterations and additions to the invention embodiments disclosed may be made without departure from the spirit and scope of the invention as set forth in the appended claims.

What is claimed is:

1. An instructional game comprising:

(a) a playing field, (b) indicia on the field representing a path along which each of multiple players are to move a game piece, (c) the indicia indicating a start position for the game pieces, (d) the indicia defining divisions of the path into multiple stops along the path, (e) a substantially random piece-movement control device for determining how many stops a player's piece is to be moved, (f) indicia on the field identifying each of several groups of the stops with one of the multiple players, (g) a deck of cards, (h) at least one indicator on multiple sets of cards in the deck associating each set of cards in the deck with one of the several groups of the stops or one of the multiple players, (i) each card of each set of cards having imprinted on one side a question and at least one answer, the question to be asked by a player identified with a stop on which another player's piece lands and to be answered by the player whose piece has landed on that stop, (j) the questions and answers on all of the cards being related in subject matter to a particular educational topic, the answers having associated with them one or more points to be awarded to a player correctly answering the questions, and (k) indicia on the field delineating safe landing spots and an activity related to the particular educational topic of the game, where a player whose piece lands on any of the safe landing spots thus delineated is not questioned and is rewarded with one or more points for that player's participation in that activity.

2. The game according to claim 1, wherein the stops of each of the groups of stops are sequentially arranged one-after-another on the path.

3. The game according to claim 1, wherein the safe landing spots are printed with activities deemed praiseworthy in the context of the game and players whose pieces land on the safe landing spots are considered to have participated in such activities.

4. The game according to claim 1, wherein the game further comprises a score card, the score card having indicia indicating the players and providing for the award of points to the players.

5. The game according to claim 4, wherein game instructions are a part of the game, the game instructions indicating that one or more points are to be awarded to a player that correctly answers a question.

6. The game according to claim 5, the game instructions indicating that one or more points are to be awarded to a player who has posed a question that is correctly answered.

7. The game according to claim 1, wherein at least a plurality of the stops, the pieces and the cards are marked for association.

8. The game according to claim 7, wherein the at least a plurality of the stops, the pieces and the cards are color coded for association.

9. The game according to claim 1, wherein the deck of cards includes a sample card for teaching the play of the game and having printed thereon a sample question and an answer to the sample question.

10. The game according to claim 1; wherein the field is on a game board.

11. The game according to claim 1; wherein the field is on a computer monitor display.

12. An instructional computer game program in computer-executable code on a computer-usable medium comprising:

(a) programming for depicting a playing field on a computer monitor;

(b) programming for displaying in the field a path for the movement of virtual game pieces and including a start position and multiple stops along the path;

(c) programming for depicting a plurality of game pieces on the monitor;

(d) a substantially random number generating means for determining the number of stops a game piece can move;

(e) programming for depicting a multiplicity of question and answer sites bearing questions and answers relating to a particular educational topic;

(f) programming visually coding for visual association groups of the stops on the path and sets of the question and answer sites;

(g) programming for posing a question to a player whose piece has moved to a stop from a set of question and answer sites coded for visual association with that stop;

(h) programming for awarding one or more points to a player correctly answering a question posed;

(i) programming associating certain of the stops with activities relating to the topic of study; and (j) programming awarding points to a player whose piece lands on the activities associated stops.

13. The game program according to claim 12, further comprising programming awarding points to a player posing a question correctly answered by another player.

14. The game according to claim 12, further comprising programming visibly marking a player's game piece for association with question and answer sites and stops associated with that player.

15. A method of developing and implementing an educational game, comprising:

(a) identifying a topic of study;

(b) devising questions and answers relating to the topic of study;

(c) providing a series of sites for carrying the questions and answers;

(d) printing the questions and answers on the sites;

(e) providing a plurality of player or playing team representative pieces that are visually distinct from one another;

(f) providing a path for moving the pieces on divided into a series of stops by indicia;

(g) providing a display of a randomly selected number of stops onto which to move a piece;

(h) providing groups of the stops, the pieces and sets of the question and answer sites with visually coordinating coding associating each piece with a group of stops and a set of the question and answer sites;

(i) identifying activities deemed praiseworthy and related to the topic of study;

(j) providing free stops associated with the praiseworthy activities where players whose pieces land on the free stops are rewarded; and (k) establishing point awards for players correctly answering questions.

16. The method according to claim 15, further comprising establishing points awards for players whose pieces land on "free" stops representing rewards for participating in the activities deemed praiseworthy.

17. The method according to claim 15, wherein the sites of the questions and answers are provided on a deck of cards.

18. The method according to claim 15, wherein the sites of the questions and answers are provided on computer generated representations of cards.

19. The method according to claim 15, wherein the stops, the players' pieces and the sites of the question and answers are visually coded to associate each player's set of sites, playing piece and stops along the path.

20. The method according to claim 15, further comprising providing a sample question and answer site bearing a broad general question relating to topic of study and an answer for demonstrating the play of the game.

21. The method according to claim 15, wherein step (f) comprises:

(i) providing a game board; and (ii) printing indicia on the game board delineating the path.

22. The method according to claim 15, wherein step (f) comprises:

(i) programming the representation of the path for display on a computer monitor.

23. The method according to claim 15, further comprising setting forth game rules calling for the posing of a question by a player from a site visually coded similarly to the player's piece.

24. The method according to claim 23, wherein setting forth the game rules comprises providing a set of printed instructions.

25. The method according to claim 23, wherein setting forth game rules comprises providing computer programming in accordance with the game rules.

26. The method according to claim 15, further comprising providing a lesson plan on the topic including concepts embodied in the questions and answers.

27. An instructional game for teaching public policy, including what public policy is, how public policy is formed and how an individual can affect public policy, the game comprising:

(a) a playing field, (b) indicia on the field representing a path along which each of multiple players are to move a game piece, (c) the indicia indicating a start position for the game pieces, (d) the indicia defining divisions of the path into multiple stops along the path, (e) a substantially random piece-movement control device for determining how many stops a player's piece is to be moved, (f) indicia on the field identifying each of several groups of the stops with one of the multiple players, (g) a deck of cards, (h) at least one indicator on multiple sets of cards in the deck associating each set of cards in the deck with one of the several groups of the stops or one of the multiple players, (i) each card of each set of cards having imprinted on one side a question relating to public policy, what public policy is or how public policy is established or influenced, and at least one answer to the question relating to public policy, the public policy question to be asked by a player identified with a stop on which another player's piece lands and to be answered by the player whose piece has landed on that stop, (j) the questions and answers on all of the cards being related to the subject of public policy, and (k) wherein indicia on the field delineate safe landing spots where a player whose piece lands on that safe landing spot is not questioned and is rewarded, one or more of the safe landing spots being imprinted with indicia denoting a player's participation in an activity that is praiseworthy in the context of the game and is an activity by which an individual can legitimately endeavor to affect public policy.

28. The game according to claim 27, wherein the safe landing spots are imprinted with one or more of indicia indicating voting, participating in a meeting of a body affecting public policy, running for public office, and communicating with a lawmaker.

* * * * *